United States Patent [19]

Shimogawara

[11] Patent Number: 4,653,944

[45] Date of Patent: Mar. 31, 1987

[54] CHARACTER SELECTING MECHANISM FOR A SERIAL PRINTER

[75] Inventor: Jun Shimogawara, Tokyo, Japan

[73] Assignee: NEC Corporation, Tokyo, Japan

[21] Appl. No.: 742,155

[22] Filed: Jun. 6, 1985

[30] Foreign Application Priority Data

Jun. 6, 1984 [JP] Japan ..... 59-116280

[51] Int. Cl.[4] ..... B41J 1/32

[52] U.S. Cl. ..... 400/144.1; 400/169; 400/144.2; 400/229

[58] Field of Search ..... 400/144, 144.1, 163.1, 400/163.3, 169, 144.2, 144.3, 185, 187, 225, 229, 664, 665

[56] References Cited

U.S. PATENT DOCUMENTS

| | | | |
|---|---|---|---|
| 3,419,125 | 12/1968 | Spaleny | 400/185 X |
| 4,389,126 | 6/1983 | Honma et al. | 101/93.05 X |
| 4,472,073 | 9/1984 | Valle et al. | 400/185 |
| 4,509,872 | 4/1985 | Shimogawara | 400/144.1 |

FOREIGN PATENT DOCUMENTS

| | | | |
|---|---|---|---|
| 0033226 | 8/1981 | European Pat. Off. | 400/144.1 |
| 2639939 | 5/1977 | Fed. Rep. of Germany | 400/163.1 |
| 197645 | 3/1978 | Fed. Rep. of Germany | 400/144.1 |
| 3340372 | 5/1984 | Fed. Rep. of Germany | 400/144.1 |
| 2050950 | 1/1981 | United Kingdom | 400/169 |

*Primary Examiner*—Paul T. Sewell

*Attorney, Agent, or Firm*—Sughrue, Mion, Zinn, Macpeak & Seas

[57] ABSTRACT

A serial printer of the print thimble type is provided with a character selecting mechanism tied in with the ribbon advance mechanism. A drive gear is rotationally rigid with the print thimble and is driven to rotate by a gear of greater thickness than the vertical shift experienced by the drive gear when switching between characters located on vertically spaced circumferences of the print thimble. A locking pawl mechanism rotationally locks the drive gear during printing to stabilize the print thimble to improve printing quality. The locking pawl is actuated by a cam mechanism driven by the ribbon advance.

9 Claims, 15 Drawing Figures

FIG 1
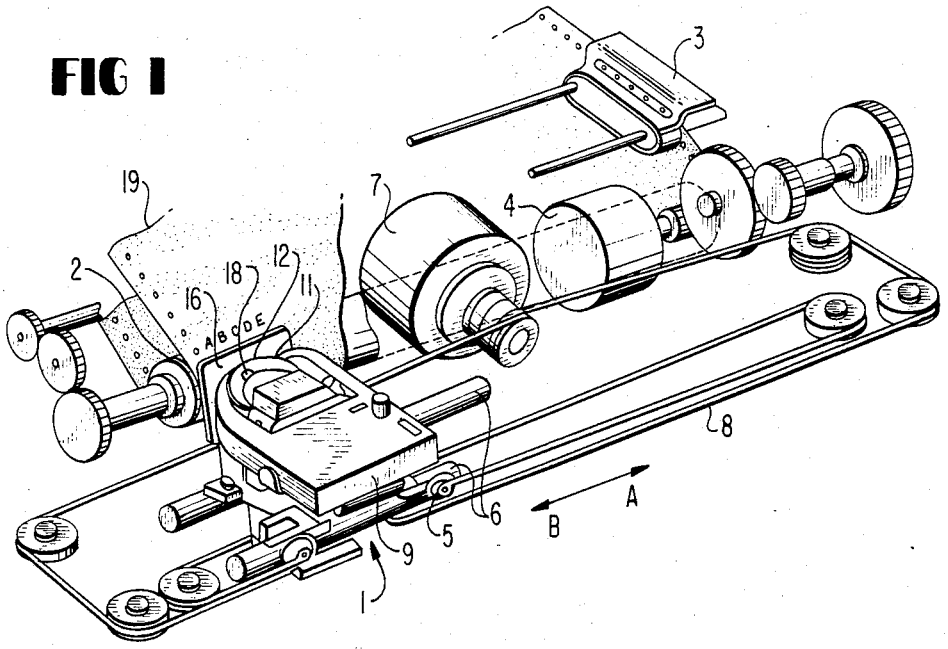
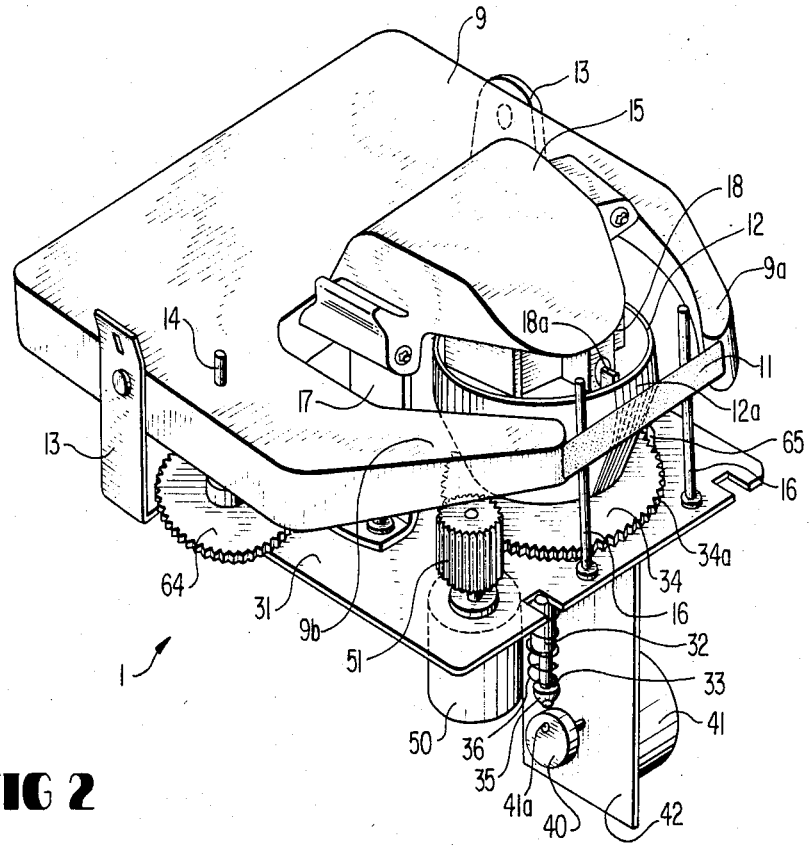
FIG 2

FIG 3
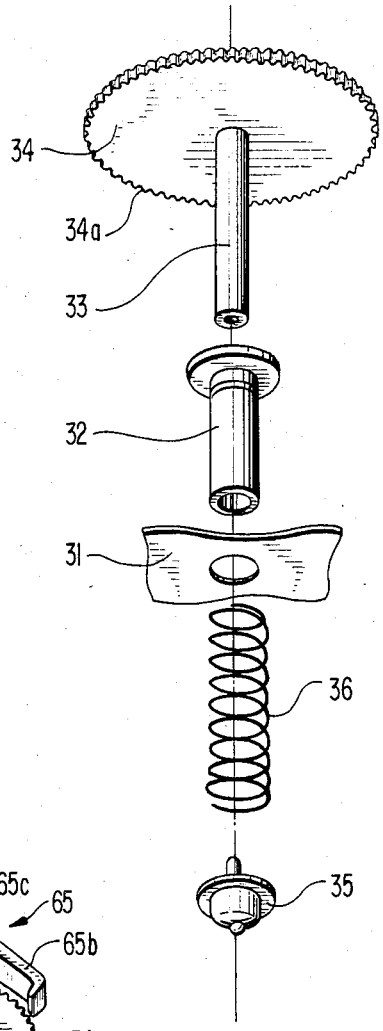
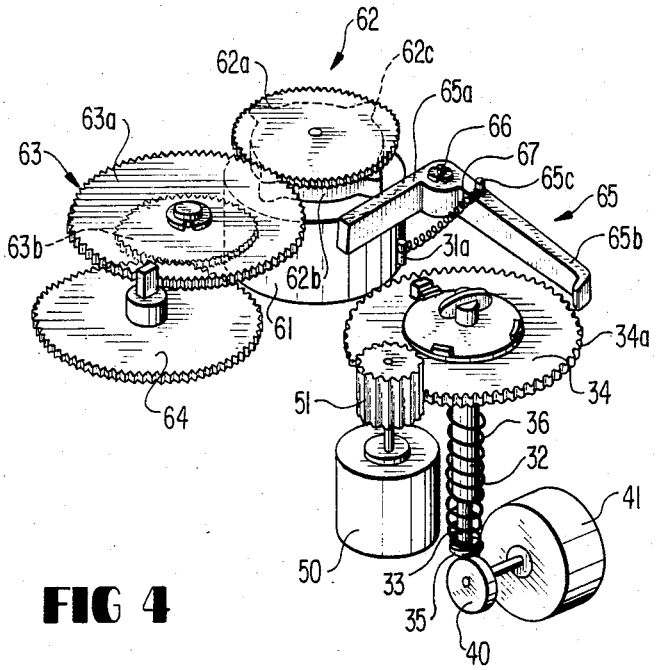
FIG 4

CHARACTER SELECTING MECHANISM FOR A SERIAL PRINTER

BACKGROUND OF THE INVENTION

The present invention relates to a serial printer or typewriter having a petal-type print thimble, and more particularly to a character selecting mechanism which selects that one of the characters to be printed from sets of characters arrayed on upper and lower positions on the circumferential surface of the print thimble by enabling the print thimble to rotate around its vertical axis and to shift the vertical direction.

Such a serial printer or typewriter comprises a petal-type print thimble having a set of elastic fingers disposed in the form of petal. A plurality of characters are arrayed along plural outer circumferences of the set of elastic fingers. Namely, the characters are arranged on upper and lower positions on circumferences of the print thimble. Such a print thimble is disclosed in U.S. Pat. Nos. 4,389,126 and 4,509,872. In order to select one of the characters, the serial printer has a character selecting mechanism by which the printer thimble is rotated in a horizontal direction and is also shifted in a vertical direction. The character to be printed is located between the paper on the platen and a print hammer by the character selecting mechanism.

The serial printer disclosed in U.S. Pat. No. 4,389,126 comprises a print thimble which is shiftable along the shaft of a rotary motor for rotating the print thimble. A torque piece is fixed to the motor shaft and a vertical slide sleeve is slidably coupled to the motor shaft in the axial direction of the motor shaft. The vertical slide sleeve engages the torque piece so as to be rotated together with the torque piece by the rotary motor. Further, the vertical slide sleeve engages cam means provided on the rotary shaft of a vertical motor. The vertical motor shifts the vertical slide sleeve in the vertical direction. The print thimble is mounted on a torque disk provided on the vertical slide sleeve, so as to be rotated in the horizontal direction by the rotary motor and shifted in the vertical direction by the vertical motor.

The character selecting mechanism requires a torque piece and a vertical slide sleeve, which are structurally complicated and difficult to manufacture. Further, since the print thimble is not directly secured to the shaft of the rotary motor, the rotational positioning of the print thimble is slightly rotationally deflected with respect to the rotational angle of the rotary motor.

The printer disclosed in U.S. Pat. No. 4,509,872 includes a rotary motor having an axially movable shaft. The rotor of the rotary motor is shorter than the stator in the axial direction. The print thimble is attached to the upper end of the shaft. The other end of the shaft engages a plane cam driven by a vertical motor. The vertical motor rotates to vertically shift the rotary motor shaft via the plane cam so as to displace the print thimble to the upper or lower position. This character selecting mechanism requires an expensive rotary motor due to its special structure with the result that the manufacturing cost of the printer is increased.

Further, in both of the above-mentioned character selecting mechanisms, the rotary axis of the print thimble is disposed on an extension of the shaft axis of the rotary motor. Therefore, these mechanisms require a large space in the vertical direction. Furthermore, since no mechanism is provided for locking the print thimble in the rotational direction during the printing operation, the print thimble may rotate slightly owing to the impact of the print hammer, and the selected character will be slightly deflected. As a result, the printing quality is poor.

SUMMARY OF THE INVENTION

Therefore, an object of the present invention is to provide a character selecting mechanism having a simple structure.

Another object of the present invention is to provide a character selecting mechanism employing a rotary motor of standard structure for rotating the print thimble in the horizontal direction.

A further object of the present invention is to reduce the vertical length of the character selecting mechanism, contributing to the miniaturization of the printer.

An additional object of the present invention is to provide an improved character selecting mechanism having a locking mechanism for preventing the print thimble from rotating during a printing operation.

According to the present invention, there is provided a character selecting mechanism for a serial printer comprising: a print thimble having a plurality of elastic fingers arranged in the form of a petal, and a plurality of characters arrayed along plural circumferences of the set of the elastic fingers, the circumferences having different heights in the vertical direction; disk means for rotatably mounting the print thimble in the horizontal direction yet allowing the thimble to be movable in the vertical direction, the disk means having a plurality of teeth formed around its outer circumference; shifting means engaging the shaft of the disk means so as to move the disk means in the vertical direction by the shifting height; first rotating means having a gear engaging the teeth of the disk means to rotate the disk means, the gear having a greater thickness than the shifting height of the shifting means; second rotating means for feeding an inked ribbon passing near the circumferences of the print thimble; rotary cam means provided on said second rotating means; and a detent lever having a cam follower portion contacting the rotary cam means and a detent portion brought into or out of engagement with the teeth of the disk means in response to the rotation of the second rotating means.

BRIEF DESCRIPTION OF THE DRAWING

The above-mentioned and other objects, features and advantages of the present invention will be better understood from the following description of preferred embodiments of the present invention taken in conjunction with the accompanying drawings, wherein:

FIG. 1 is a perspective view illustrating major portions of a serial printer according to an embodiment of the present invention;

FIG. 2 is a perspective view of a carrier unit used in the preferred embodiment shown in FIG. 1;

FIG. 3 is an exploded perspective view illustrating a disk means and associated parts used in the carrier unit shown in FIG. 2;

FIG. 4 is a perspective view of the major portions of the carrier unit according to a first embodiment of the present invention;

DESCRIPTION OF THE PREFERRED EMBODIMENT

Figure 5A:
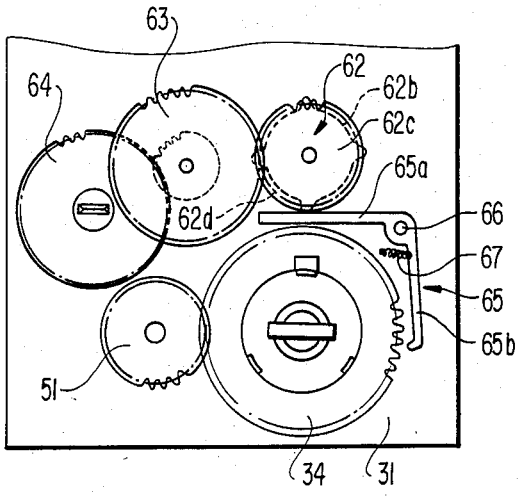
FIGS. 5A and 5B are plan views illustrating the positional relationship between a detent lever and a ribbon feed motor gear.

Referring to FIG. 1, the preferred embodiment of the printer comprises a carrier unit 1, a platen 2 opposed to the carrier unit 1, a tractor unit 3 for feeding paper 19 wound around the platen 2, and a pulse motor 4 for driving the platen 2 and the tractor 3. The carrier unit 1 is supported on two guide shafts 6 by means of guide bearings 5. The shafts 6 are secured to a frame (not shown) of the printer. The carrier unit 1 is transported in parallel with the platen 2 by a spacing motor 7 through spacing wires 8.

The carrier unit 1 mounts an inked ribbon cassette 9, a petal-type print thimble 12, a print hammer mechanism 18 and motors for driving the same. The print hammer mechanism 18 prints that character which is selected among those arrayed on the print thimble 12 onto the paper 19 through the inked ribbon 11 guided by an inked ribbon guide 16. The carrier unit 1 is moved on the guide shaft 6 by the spacing motor 7 stepwise to successive positions for printing one character at a time. When printing is completed for one line, the paper 19 is advanced by one printing line by the pulse motor 4. The carrier unit 1 is operated in the same way as in the preceding printing line to again print characters on the paper 9.

Referring to FIG. 2, the inked ribbon cassette 9 is held by the arms 13 of the carrier unit base 31. The feed roller shaft 14 of the ribbon cassette 9 engages a ribbon feed piece 64 attached rotatably to the base 31. The inked ribbon 11 runs out of the cassette 9 through an exit arm 9*a*, runs on the outer side of two ribbon guides 19, and returns to an entrance arm 9*b*. Namely, the inked ribbon 11 runs between the print thimble 12 and the platen 2 guiding by the ribbon guides 16.

The print hammer mechanism 18 is fixedly held in a hammer cover 15 supported by leg members 17. The leg members 17 are provided on the base 31. A print hammer 18*a* is positioned within the inner space of the print thimble 12 to strike the rear surface of a finger 12*a*.

The print thimble 12 is mounted on a disk 34 having a plurality of teeth 34*a* formed around its circumference. As shown in FIG. 3, the disk 34 has a rotary shaft 33 extending downward at its central portion. The shaft 33 is inserted into the bushng 32 fixedly secured to the base 31 so as to be able to rotate and move vertically in the bushing 32. A cam follower 35 is secured to the lower end of the shaft 33. The cam follower 35 is urged to contact an eccentric cam 40 by a spring 36.

Referring to FIG. 2 again, the eccentric cam 40 is attached to the shaft 41*a* of a thimble shifting motor 41 fixedly mounted on a vertical bracket 42. The eccentric cam 40 has cylindrical shape and the shaft 41*a* is located at a portion eccentric to the central axis of the cylindrical cam 40. The bracket 42 is secured substantially at a right angle to the underside of the base 31. The shifting motor 41 rotates to shift the disk shaft 33, the disk 34 and the print thimble 12 in the vertical direction through the cam mechanism, i.e., the cam 40 and the cam follower 35. Namely, the vertical position of the print thimble 12 is determined by the rotational angle of the shifting motor 41.

A thimble rotating motor 50 is provided on the underside of the base 31. The shaft of the motor 50 has a gear 51 for engaging the teeth 34*a* of the disk 34. The height (thickness) of the gear 51 in the axial direction is greater than the vertical distance movable by the disk 34. The motor gear 51 engages the disk 34 with adequate backlash.

The motor 50 causes the toothed disk 34 and the print thimble 12 to rotate via the motor gear 51. Since the gear 51 has sufficient thickness to cover the vertical movement of the disk 34, the teeth 34*a* always engage the gear 51 regardless of the vertical position of the disk 34. The number of teeth 34*a* is equal to the number of the fingers 12*a* of print thimble 12, which is 64.

Figure 5B:
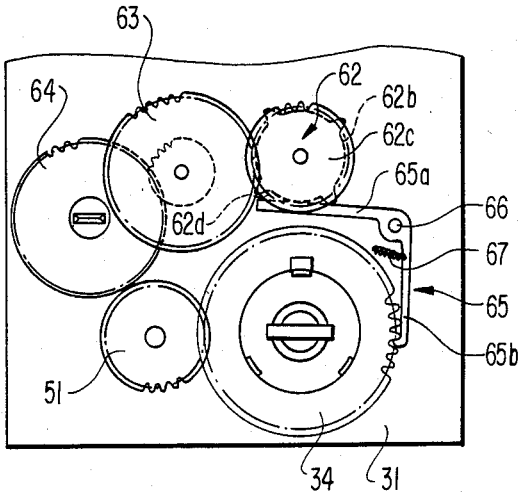

Referring to FIGS. 4, 5A and 5B, a drive gear assembly 62 is rotatably mounted on the base 31 for rotating a ribbon feed piece 64 via an idler gear assembly 63. The gear assembly 62 has a gear section 62*a* on its upper portion for engaging the idler gear assembly 63 and a cam section 62*b* on its lower portion for actuating a detent lever 65. The gear and cam sections 62*a* and 62*b* are integrally formed having a common rotational shaft. A ribbon feed motor 61 is provided on the underside of the base 31 to rotate the gear assembly 62.

The idler gear assembly 63 is rotatably mounted on the base 31 through its rotational shaft. The gear assembly 63 includes upper gear section 63*a* engaging the gear section 62*a* and a lower gear section 63*b* having a smaller diameter than that of the upper gear 63*a* and engaging the ribbon feed piece 64.

An L-shaped detent lever 65 is swingably mounted on the base 31 by a pivot shaft 66. The lever 65 includes a cam follower portion 65*a* and a detent portion 65*b*. A spring 67 is hooked at one end to a pin 65*c* formed on the detent lever 65 and at the other end to a post 31*a* formed on the base 31 to urge the detent lever 65 clockwise. Accordingly, the cam follower portion 65*a* is pressed to the outer surface of the cam section 62*b* and the detent portion 65*b* is urged towards the outer circumference of the disk 34. The cam section 62*b* is provided on the circumference with four lobes 62*c* spaced at right angles from each other.

In accordance with the rotation of the motor 61, when one of the lobes 62*c* contacts the cam follower portion 65*a*, the lever 65 turns counterclockwise against the spring 67 such that the pawl of the detent portion 65*b* is removed from the disk 34, as shown in FIG. 5A. Thus, the disk 34 is free to rotate. When the ribbon feed motor 61 further rotates by 45° to bring the cam follower 65*a* into contact with the sector portion 62*d* of the cam section 62*b*, the lever 65 is actuated to turn clockwise by the spring 67 such that the pawl of the detent portion 65*b* engages one of the teeth 34*a* of the disk 34 (FIG. 6). Thus, the disk 34 and also the print thimble 12 are prevented from rotating.

The ribbon feed motor 61 is a four phase stepping motor having a step angle of 22.5° corresponding to one fourth the angular interval (90°) between the lobes 62*c* of the cam section 62*b*. That is, the motor 61 is intermittently rotated by 45° by two stepping pulses, and the cam follower 65*a* engages the lobe 62*c* or the sector portion 62*d* by turns every time the motor 61 is stopped.

The operation of the character selecting mechanism will be described with further reference to FIGS. 6A, 6B, 7A and 7B.

Figure 6A:
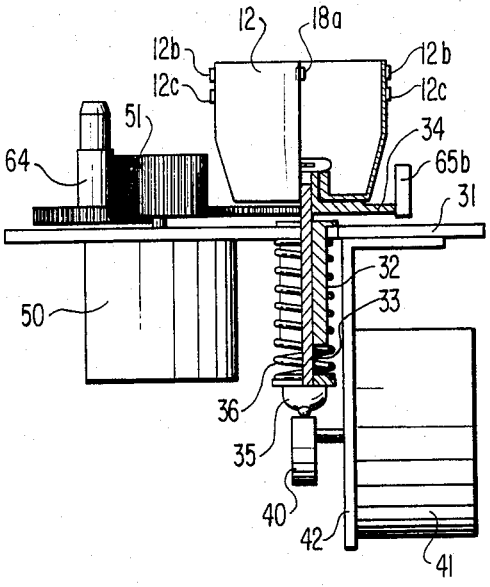
FIGS. 6A, 6B, 7A and 7B are side views illustrating the vertical shift of a print thimble in response to a vertical motor.
Figure 6B:
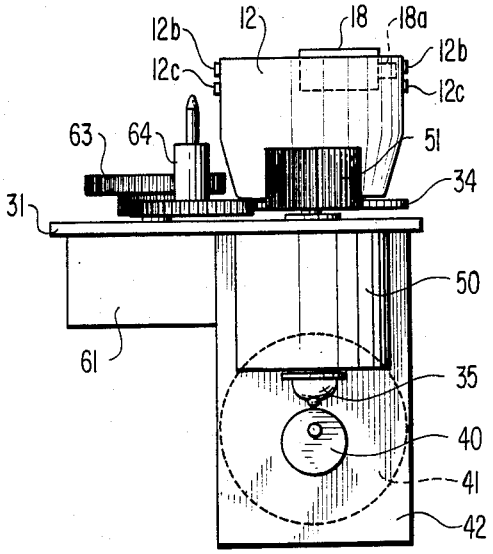
Figure 7A:
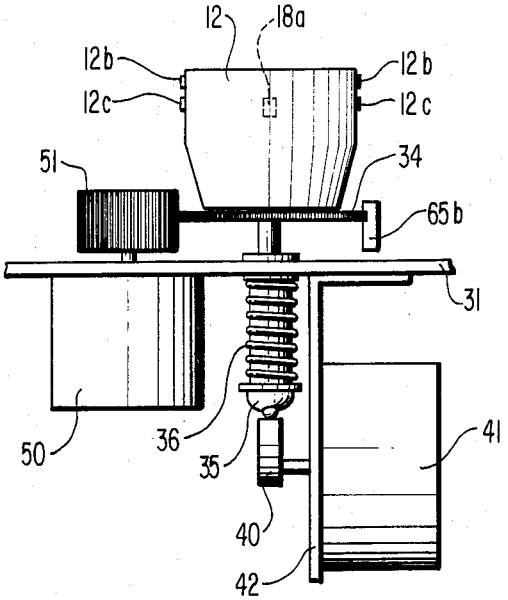
Figure 7B:
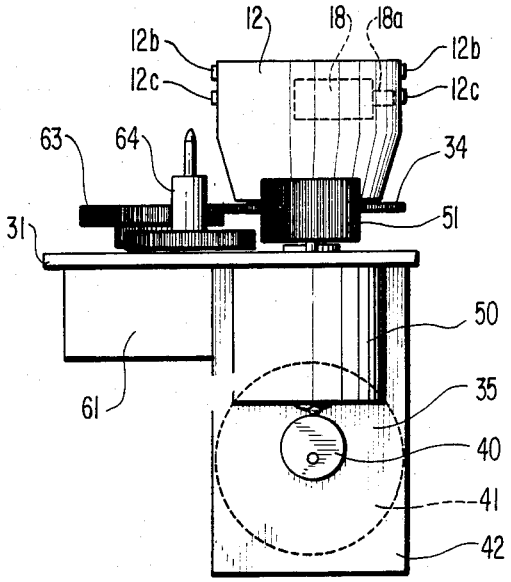

Initially, the carrier unit 1 is in the state shown in FIG. 5B. First, the ribbon feed motor 61 rotates by 45° to feed the inked ribbon 11. The rotation of the motor 61 is transmitted to the ribbon feed piece 64 through the gear section 62*a* and the idler gear assembly 63 and also actuates the detent lever 65 to turn counterclockwise so as to remove the detent portion 65*a* from the teeth 34*a* of the disk 34, as shown in FIG. 5. Subsequently, the motor 50 rotates the print thimble 12 until the finger having the desired character to be printed is opposed to the print hammer 18*a*. When the desired character is a member of the upper line of characters 12*b*, the thimble shifting motor 41 is rotated to shift the print thimble 12 to the lower position, as shown in FIGS. 6A and 6B. On the contrary, when the desired character is a member of the lower characters 12*c*, the print thimble 12 is located at the upper position, as shown in FIGS. 7A and 7B.

Then, the ribbon feed motor 61 further rotates by 45° and the mechanism returns to the state shown in FIG. 6. The detent portion 65*a* engages one of the teeth 34*a* to prevent the disk 34 from rotating. Subsequently, the print hammer mechanism 18 is actuated to imprint the selected character on the paper 19 through the inked ribbon 11. The gear ratio of the gear section 62*a* of the ribbon feed motor 61, the upper and lower gear sections 63*a* and 63*b* of the idle gear assembly 63 and the ribbon feed piece 64 should be set such that the total rotation before and after the character selecting of the ribbon feed motor 61 (45°+45°=90°) corresponds to the feed length of the inked ribbon 11 for printing one character. The ratio of gears 62*a*, 63*a*, 63*b* and 64 is set to 18:60:16:68 in this embodiment.

Figure 8:
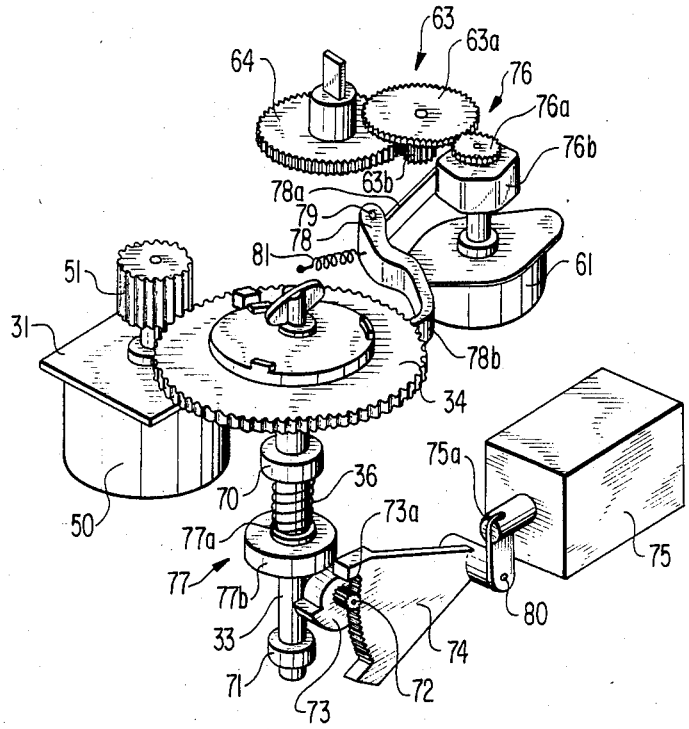
FIG. 8 is a perspective view of the major portions of the carrier unit according to a second embodiment of the present invention.

In an another embodiment according to the present invention, as shown in FIG. 8, a solenoid device 75 is employed for up and down shifting of the print thimble 12 and a drive gear assembly 76 having a hexagon-profiled cam is employed for turning the detent lever 78.

The disk 34 is provided on the carrier unit 1 with its shaft 33 inserted in the bushing 70 and 71 which are secured to the carrier unit base 31, so that the disk 34 can be rotatable yet shiftable in the vertical direction. The inner wheel 77*a* of a ball bearing 77 is fixed at the center position of the shaft 33 in the axial direction. A spring 36 is provided between the bush 70 and ball bearing 77.

The outer wheel 77*b* of the ball bearing 77 contacts a cam 73 at its underside portion. The cam 73 rotates about the shaft 72 and has a profile such that the distance from the shaft 72 to the cam surface is gradually increased in accordance with the rotational angle of the cam 73. The cam 73 has a gear portion 73*a* at its side surface, which engages the sectorial arm 74. The arm 74 is actuated to swing about a pivot 80 by the link mechanism connected to the plunger 75*a* of the solenoid device 75.

Figure 9A:
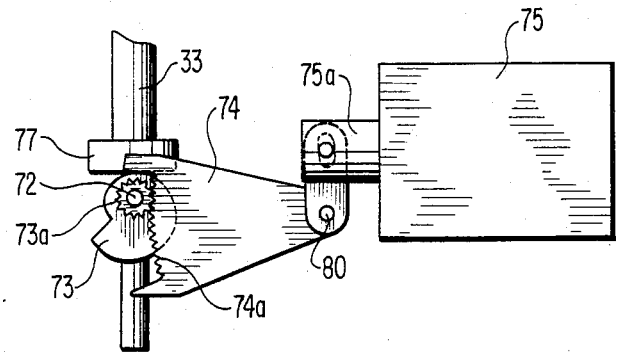
FIGS. 9A and 9B are side views showing the shift of the disk shaft in response to a solenoid actuator and FIGS. 10A and 10B are plan views illustrating the positional relationship between a detent lever and a ribbon feed motor gear.
Figure 9B:
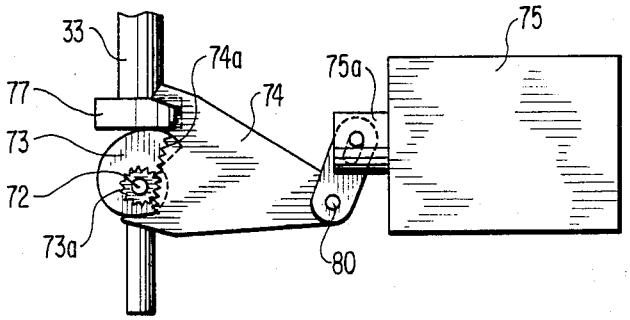

Referring to FIGS. 9A and 9B, when the solenoid device 75 actuates the plunger 75*a* to project out (FIG. 9A) or pull in (FIG. 9B), the sectional arm 74 turns counterclockwise or clockwise, respectively. Thus, the cam 73 rotates clockwise or counterclockwise to move the shaft 33 of the disk 34 upward (FIG. 9A) or downward (FIG. 9B).

Referring to FIG. 8 again, the ribbon feed piece 64 is connected to the feed gear assembly 76 fitted on the ribbon feed motor 61 through an idler gear assembly 63. The gear assembly 76 has a gear section 76*a* for engaging the upper gear 63*a* of the gear assembly 63, and a cam section 76*b* for connecting a cam follower 78*a* of a detent lever 78. The cam section 76*b* has a hexagonal cam profile, i.e., the intersections are positioned at regular angular intervals of 60°. The detent lever 78 is rotatably provided around a pivot 79 on the base 31, which has a detent portion 78*b* for engaging the teeth 34*a* of the disk 34. The lever 78 is urged clockwise by a spring 81.

Figure 10A:
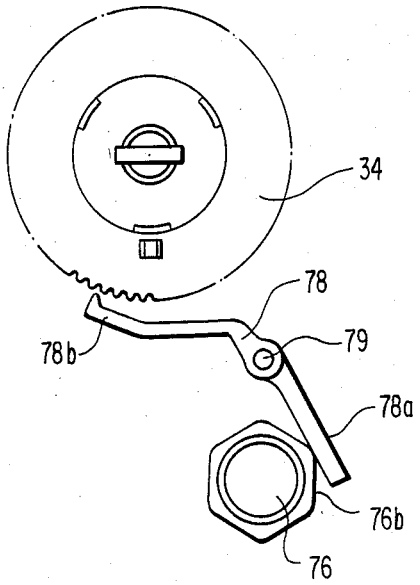
Figure 10B:
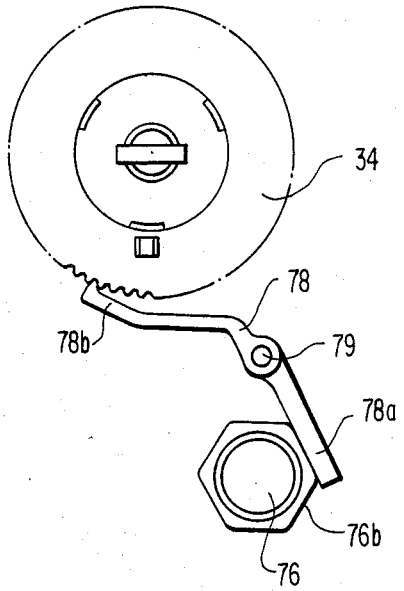

Referring to FIGS. 10A and 10B, in accordance with the rotation of the ribbon feed motor 61, the detent lever 78 turns counterclockwise to remove the detent portion 78*b* from the teeth 34*a* of the disk 34, when the intersection of the cam section 76*b* engages the cam follower 78*a*, as shown in FIG. 10A. Then, the disk 34 is free to rotate. When the ribbon feed motor 61 further rotates by 30° to bring the cam follower 78*a* into contact with the plane surface of the cam section 76*b*, the detent lever 78 turns clockwise to engage the pawl of the detent portion 78*b* with one of the teeth 34*a* of the disk 34. Thus the disk 34 is locked against rotation. In the preferred embodiment, a four phase stepping motor is used as the ribbon feed motor 61, which has a step angle of 15° corresponding to one forth the angular interval (60°) between the intersections. That is, the motor 61 is intermittently rotated by 30° by two stepping pulses, and the cam follower 78*a* engages the intersection or the plane surface by turn every time the motor 61 is stopped.

In this embodiment, the printing operation is carried out in the same manner as in the first embodiment. First, the ribbon feed motor 61 rotates by 30° to feed the inked ribbon 11 as well as to actuate the detent lever 78 to remove the pawl from the disk 34, as shown in FIG. 10A. Then, the print thimble 12 is rotated by the thimble rotating motor 50 and shifted by the solenoid device 75, so that the character to be printed is aligned with the print hammer 18*a*. Subsequently, the ribbon feed motor 61 further rotates by 30° to feed the inked ribbon 11 as well as to actuate the detent lever 78 to engage one of the teeth 34*a* of the disk 34 (FIG. 11B). The disk 34 is locked and prevented from rotating. Then, the print hammer 18 is actuated to imprint the selected character on the paper 19. For adjusting the rotations of the ribbon feed motor 61 before and after the character selection (30°+30°=60°) to be correspondent to the feed length of the inked ribbon, the numbers of teeth of the gear section 76*a*, the upper and lower idler gears 63*a*, 63*b*, and the ribbon feed piece 64 are set to 27, 60, 16 and 68, respectively. The rotation of the motor 61 by 60° enables the ribbon feed piece 64 to rotate by 1/56 turn.

As described above, in the character selecting mechanism according to the present invention, the motor for rotating the print thimble has a gear having a large thickness, and the print thimble has a disk base engaging the gear. The rotational location of the print thimble is determined by the detent lever which is actuated by the ribbon feed motor. Accordingly, a standard motor can be employed as the rotary motor, and the structure of the character selecting mechanism can be simplified.

What is claimed is:

1. A character selecting mechanism for a serial printer, comprising:

a print thimble having a set of elastic fingers arranged in the form of a petal, and a plurality of characters arrayed along plural circumferences of the set of elastic fingers, said circumferences having different heights in the vertical direction;

disk means for mounting said print thimble so as to be rotatable in the horizontal direction and movable in the vertical direction, said disk means having a plurality of teeth formed about its outer circumference, and a rotary shaft provided on the central axis of said disk means;

shifting means engaging one end of said rotary shaft so as to translate said disk means in the vertical direction by a predetermined shift distance;

first drive means having a gear engaging said teeth of said disk means to rotate said disk means, said gear having a greater thickness than said shift distance;

second drive means for intermittently feeding an inked ribbon passing near said print thimble by a ribbon feed pitch;

rotary cam means provided on a part of said second drive means; and a detent lever having a cam follower portion contacting said rotary cam means and a detent portion brought into or out of engagement with the teeth of said disk in response to the rotation of said second drive means, such that when said second drive means is rotated by said ribbon feed pitch, said detent portion is brought out of engagement with said teeth of said disk means to allow the operation of said first drive means, and when said second drive means is further rotated by one further ribbon feed pitch, said detent portion is engaged with said teeth of said disk means to prevent rotation of said disk means.

2. The character selecting mechanism as claimed in claim 1, wherein said shifting means includes an eccentric cam engaging said one end of said rotary shaft and a motor for driving said eccentric cam.

3. The character selecting mechanism as claimed in claim 1, wherein said shifting means includes a cam mechanism and sectorial arm engaging said cam mechanism, said sectorial arm being actuated by a solenoid device via a link mechanism.

4. The character selecting mechanism as claimed in claim 1, wherein the number of said teeth is equal to the number of said elastic fingers.

5. The character selecting mechanism as claimed in claim 1, including a first motor for driving said first drive means, a second motor for driving said second drive means, gear transmission means between said second motor and said rotary cam means, and a third motor for driving said shifting means, said shifting means including a cam for translating said rotary shaft in the vertical direction.

6. A character selecting mechanism for a serial printer, comprising:

a print thimble having a set of elastic fingers arranged in the form of a petal, and a plurality of characters arrayed along plural circumferences of the set of elastic fingers, said circumferences having different heights in the vertical direction;

disk means for mounting said print thimble so as to be rotatable in the horizontal direction and moveable in the vertical direction, said disk means having a plurality of teeth formed about its outer circumference, and a rotary shaft provided on the central axis of said disk means;

shifting means engaging one end of said rotary shaft so as to translate said disk means in the vertical direction by a predetermined shift distance;

first drive means having a gear engaging said teeth of said disk means to rotate said disk, means, said gear having a greater thickness than said shift distance;

second drive means for feeding an inked ribbon passing near said print thimble;

rotary cam means provided on a part of said second drive means; and a detent lever having a cam follower portion contacting said rotary cam means and a detent portion brought into and out of engagement with the teeth of said disk means in response to the rotation of said second drive means;

said rotary cam means having a plurality of protuberances spaced at regular angular intervals and sector portions between said protuberances, said detent portion disengaging said disk means when said cam follower portion engages one of said protuberances, and engaging one of the teeth of said disk means when said cam follower portion engages one of said sector portions.

7. The character selecting mechanism as claimed in claim 6, wherein said second drive includes a stepping motor having a stepping angle, an integral multiple of said stepping angle being equal to said regular angular interval.

8. The character selecting mechanism as claimed in claim 6, including means for actuating said second drive means to rotate said rotary cam means by half of said regular angular interval, for then actuating at least one of said shifting means and said first rotating means, and for then actuating said second drive means to rotate said rotary cam by an additional half of said regular angular interval.

9. A character selecting mechanism for a serial printer, comprising:

a print member including a set of elastic fingers, each of which includes a character thereon;

first drive means for rotating said print member to select one of said characters;

second drive means for intermittently feeding an inked ribbon in front of the character selected by said first drive means, said second drive means advancing by one feed pitch upon each actuation thereof, said second drive means being provided with rotary cam means rotated together with the feeding of said inked ribbon; and a movable detent lever including a cam follower portion for contacting said rotary cam means, and a detent portion, the advancement of said second drive means by one feed pitch enabling said detent portion to engage said print member to prevent said print member from rotating, and the advancement of said second drive means by a further feed pitch enabling said detent portion to be disengaged from said print member to enable the operation of said first drive means.

* * * * *